US009888776B2

(12) United States Patent
Brandhuber

(10) Patent No.: US 9,888,776 B2
(45) Date of Patent: Feb. 13, 2018

(54) SEATING/RECLINING FURNITURE

(71) Applicant: Himolla Polstermöbel GmbH, Taufkirchen/Vils (DE)

(72) Inventor: Robert Brandhuber, Neufraunhofen (DE)

(73) Assignee: HIMOLLA POLSTERMOBEL GMBH, Taufkirchen/Vils (DE)

( * ) Notice: Subject to any disclaimer, the term of this patent is extended or adjusted under 35 U.S.C. 154(b) by 0 days.

(21) Appl. No.: 15/025,006

(22) PCT Filed: Sep. 25, 2014

(86) PCT No.: PCT/EP2014/070481
§ 371 (c)(1),
(2) Date: Jul. 1, 2016

(87) PCT Pub. No.: WO2015/044264
PCT Pub. Date: Apr. 2, 2015

(65) Prior Publication Data

US 2016/0302574 A1 Oct. 20, 2016

(30) Foreign Application Priority Data

Sep. 27, 2013 (DE) ..... 10 2013 219 659

(51) Int. Cl.
*A47C 7/50* (2006.01)
*A47C 20/00* (2006.01)
(Continued)

(52) U.S. Cl.
CPC ..... *A47C 1/0342* (2013.01); *A47C 1/036* (2013.01); *A47C 1/0352* (2013.01); *A47C 1/03294* (2013.01); *A47C 7/18* (2013.01)

(58) Field of Classification Search
CPC ... A47C 1/0352; A47C 1/03294; A47C 1/036; A47C 1/0342; A47C 7/18
(Continued)

(56) References Cited

U.S. PATENT DOCUMENTS 4,678,229 A * 7/1987 Ryan ..... A47C 1/0248 248/408
4,779,921 A * 10/1988 Holmstrom ..... A47C 1/0342 297/328
(Continued)

FOREIGN PATENT DOCUMENTS

DE 69607918 T2 1/2001
DE 102005051236 A1 3/2008
(Continued)

OTHER PUBLICATIONS

Extended German search report for related German application No. 102013219659.8, dated Mar. 16, 2016, pp. 8.

*Primary Examiner* — Rodney B White
(74) *Attorney, Agent, or Firm* — Cantor Colburn LLP

(57) ABSTRACT

A seating/reclining furniture comprising a seat part, a backrest part, and a cantilever support structure. A foot support device is provided which comprises a support frame and a first and a second foot support portion, and the first foot support portion is pivotally mounted on the support frame and can be adjusted between a storage position and a working position. The second foot support portion can be adjusted linearly relative to the first foot support portion between a retracted position and an extended position. The foot support device comprises a working device which causes the first foot support portion to be pivoted relative to the support frame by means of a first fitting and the second foot support portion to be moved relative to the first foot support portion by means of a second fitting independently
(Continued)

Figure 1A:
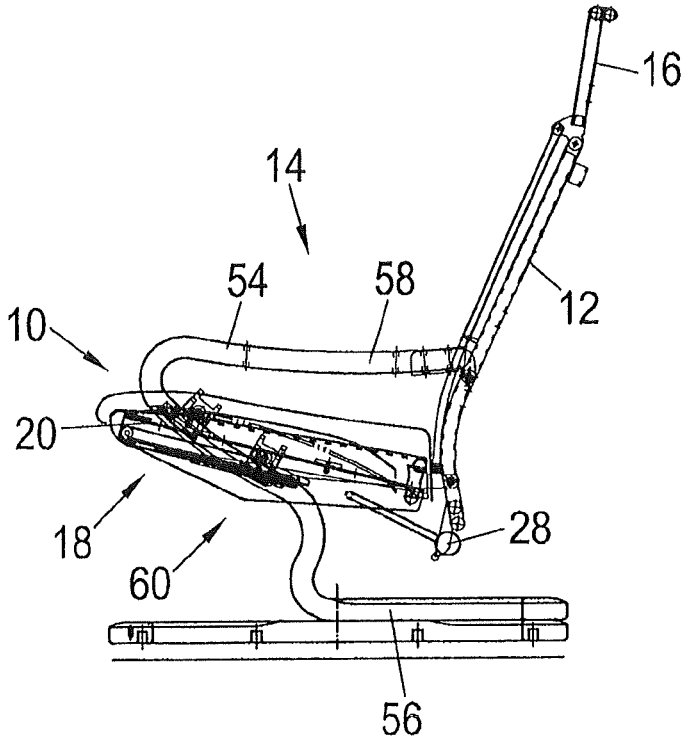

of a change of the relative position of the backrest and the seat part.

16 Claims, 11 Drawing Sheets

(51) Int. Cl.

| | |
|---|---|
| ***A47C 20/04*** | (2006.01) |
| ***A47C 20/08*** | (2006.01) |
| ***A47C 1/034*** | (2006.01) |
| ***A47C 1/035*** | (2006.01) |
| ***A47C 1/032*** | (2006.01) |
| ***A47C 1/036*** | (2006.01) |
| ***A47C 7/18*** | (2006.01) |

(58) Field of Classification Search
USPC ..... 297/423.26, 423.28
See application file for complete search history.

(56) References Cited

U.S. PATENT DOCUMENTS 5,782,535 A * 7/1998 Lafer ..... A47C 1/0342 297/423.28
5,857,739 A * 1/1999 Smith ..... A47C 1/03255 297/68
5,918,942 A * 7/1999 Olsen ..... A47C 1/035 297/423.28 X
6,517,156 B1 * 2/2003 Lin ..... A47C 1/036 297/284.4
6,517,160 B2 * 2/2003 Marcantoni ..... A47C 7/506 297/423.28
7,080,887 B2 * 7/2006 Tseng ..... A47C 1/035 297/423.28 X
7,496,979 B2 * 3/2009 Hempker ..... A61G 15/00 297/423.28
9,113,713 B2 * 8/2015 Lin ..... A47C 1/03255
2003/0015900 A1 * 1/2003 Lu ..... A47C 1/03255 297/259.1
2003/0075965 A1 4/2003 Pham et al.
2005/0035645 A1 2/2005 Tseng
2015/0305507 A1 * 10/2015 Besler ..... A47C 7/506 297/423.28
2016/0374476 A1 * 12/2016 Wu ..... A47C 7/506 297/423.28
2017/0202354 A1 * 7/2017 Mitschke ..... A47C 1/0342

FOREIGN PATENT DOCUMENTS

DE 102012218862 A1 4/2014
EP 1327400 A2 7/2003
EP 1943926 A1 7/2008

* cited by examiner

SEATING/RECLINING FURNITURE

CROSS-REFERENCES TO RELATED APPLICATIONS

This patent application is a 371 of International Application No. PCT/EP2014/070481, filed Sep. 25, 2014 which claims the priority of German Application No. 102013219659.8, filed Sep. 27, 2013, each of which are incorporated herein by reference in their entirety.

The present invention relates to seating/reclining furniture in accordance with the preamble of claim 1.

Such furniture is generally known, for example from EP 1 327 400 A2.

It is also known that a footrest is coupled via a fitting to a back part or to a seat part such that a change of the relative position of the back part and of the seat part with respect to one another effects a pivoting of the footrest.

In the non-pivoted state, the footrest is in this respect substantially oriented perpendicular to the seat part, which is disadvantageous, for example, with respect to esthetics.

The free movement of a user's feet is also prevented in this position.

It is furthermore disadvantageous that the footrest is only extended in a reclining position. It can, however, also be desirable for reasons of comfort to utilize the footrest, for example, in an upright position or in an intermediate position of the back part.

It is therefore an object of the invention to improve seating/reclining furniture with respect to comfort.

The object is satisfied by seating/reclining furniture having the features of claim 1.

In accordance with the invention, the first footrest section, together with the second footrest section, is in particular pivoted by means of a first fitting, independently of a change of the relative position of the back part and of the seat part relative to one another. A relative movement of the second footrest section to the first footrest section also takes place by means of a second fitting independently of a movement of the back part or of the seat part.

In this manner, the footrest can also be folded outward and/or extended when the backrest is located in an upright position. There is thus also a high degree of comfort when seated or in an intermediate position.

It is furthermore possible that the footrest is not extended when the backrest is located in a reclining position.

The seating/reclining furniture is consequently variably adaptable to the needs of the user due to the independent adjustability of the footrest.

The first fitting and the second fitting can in particular be components of a common fitting.

The fittings can in particular be compulsorily coupled with one another. If the drive apparatus is consequently actuated, both the first footrest section can be pivoted relative to the support frame and the second footrest section can be extended or retracted via the fittings, preferably using a single movement. The second footrest section can be connected to the first footrest section, for example, via a slot guide.

The drive can in particular take place manually, e.g. by means of a lever. An electric drive is, however, also conceivable, for example, which can preferably be controlled via a control unit connected to the seating/reclining furniture or in wireless contact therewith.

Reference is made with respect to the mode of operation and to possible embodiments of the footrest apparatus and its fittings per se to DE 696 07 918 T2 whose disclosure content in this respect is herewith explicitly referenced.

It was extremely surprising and unexpected for the skilled person that a drive apparatus can also be used together with a footrest apparatus, the two simultaneously implementing a pivot movement and extension movement, in seating/reclining furniture having a cantilever support structure such as is defined in the preamble of claim 1.

Seating/reclining furniture having a cantilever support structure namely always have a seat part whose frame is formed from a tube bent round. It therefore did not appear possible due to this basic structure and due to the low height of the seat part to arrange a corresponding footrest apparatus together with the drive apparatus beneath the seat part.

This is in particular made possible in accordance with the invention in that the seat part can have a rectangular basic structure and, for example, forms a kind of box or mount for a footrest apparatus. The footrest apparatus or at least the support frame can thus in particular be stowed beneath the seat part like a cassette or a drawer.

To have sufficient space available to pivot the footrest sections outward, the frame of the seat part is in particular not formed from a bent tube, but rather from angled border plates. A front edge of the seat part can preferably be flat, and in particular straight, in order in this manner to achieve a relatively tall height or front ground clearance for the pivot movement or extension movement of the footrest.

In this manner, the footrest sections do not contact the floor while they are pivoted.

The invention will be described in the following with reference to the drawings. They are in this respect purely exemplary embodiments. Protection is also claimed for the individually described aspects in each case separately from the specific embodiment.

An armchair having a seat part 10 and a back part 12 is shown in FIGS. 1*a* to 2*c*. The seat part 10 and the back part 12 are supported by a cantilever support structure 14. The cantilever support structure 14 comprises a support hoop 54, a base section 56, an at least approximately horizontally extending horizontal section 58 as well as a joint section 60 connecting the base section 56 and the horizontal section 58 to one another and enabling a pivoting of the horizontal section 58 relative to the base section 56.

Figure 2A:
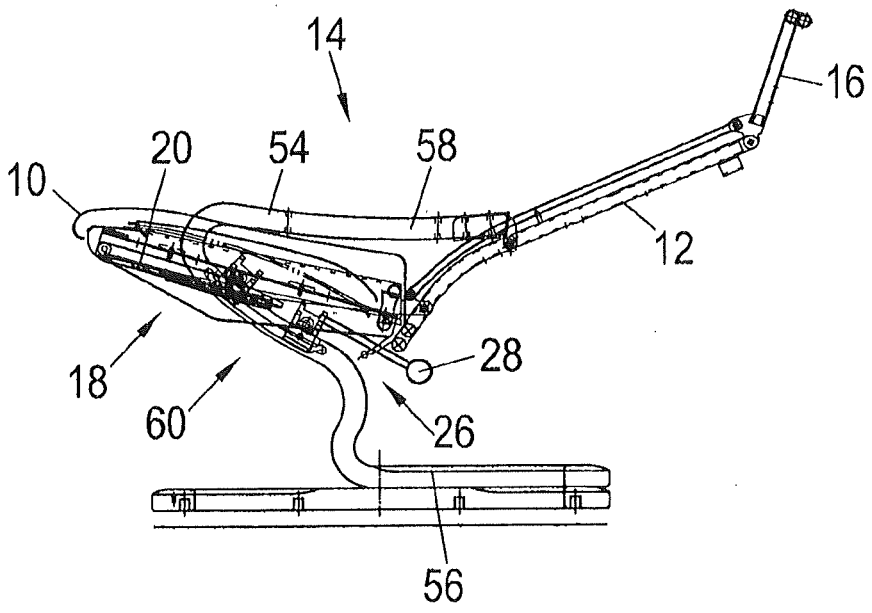
Figure 1B:
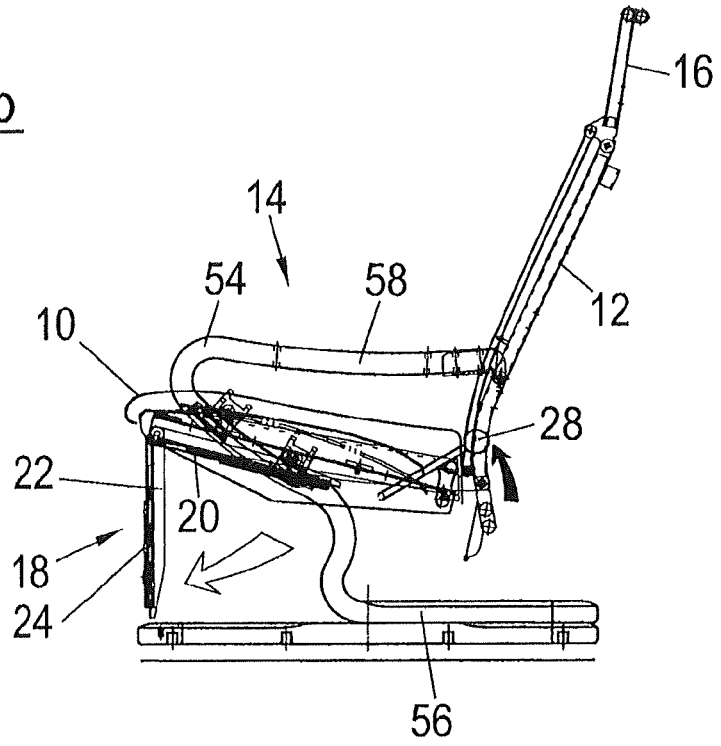
Figure 2B:
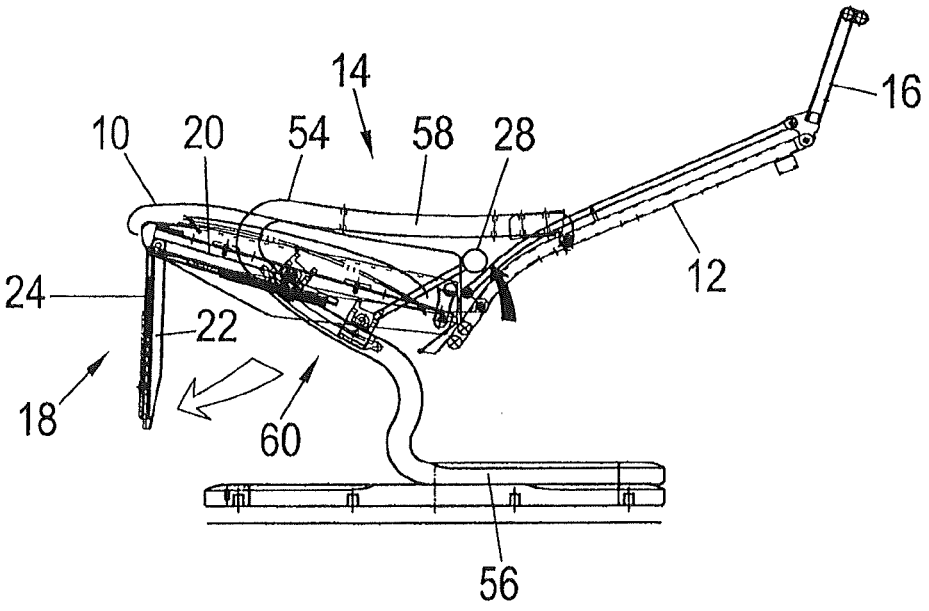
Figure 1C:
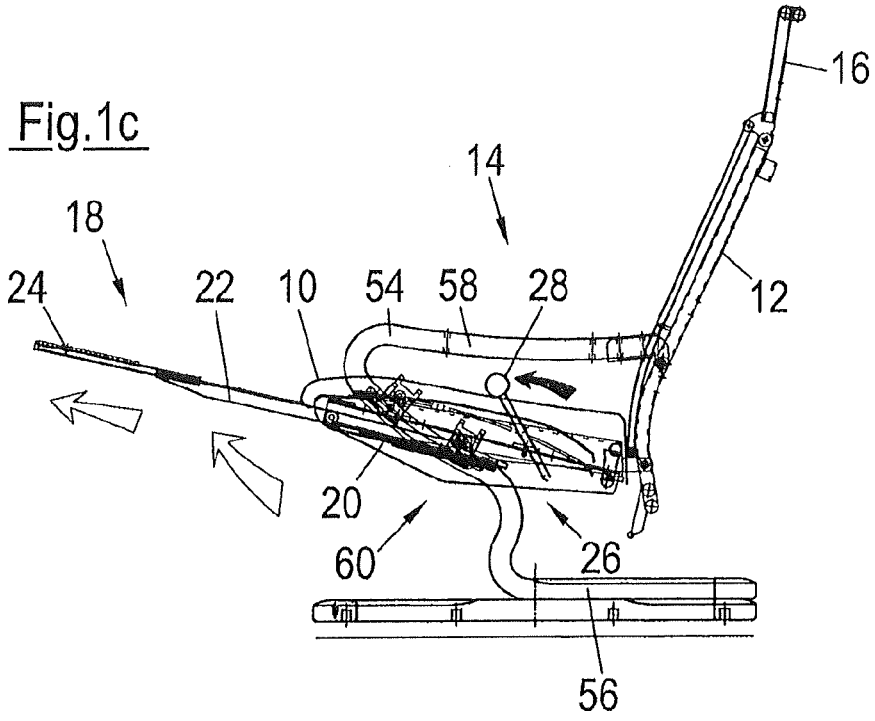
Figure 2C:
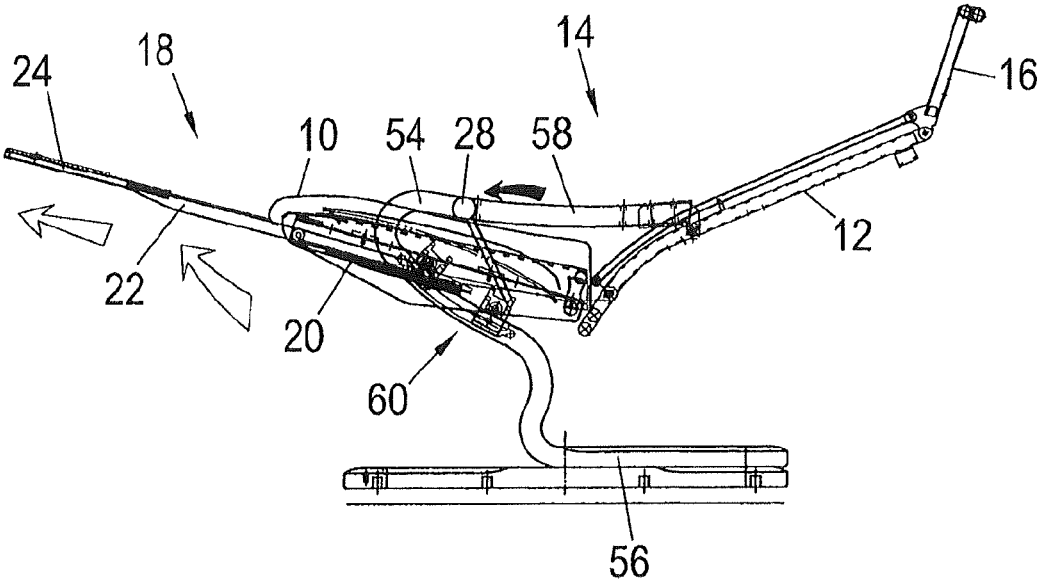

The back part 12 together with a headrest 16 is always in an upright position in FIGS. 1*a* to 1*c*, whereas a reclining position is shown in FIGS. 2*a* to 2*c*.

The adjustment mechanism for a footrest apparatus 18, however, takes place independently of whether the back part 12 is inclined or not.

The footrest apparatus 18 comprises a support frame 20, a first footrest section 22 and a second footrest section 24.

The footrest sections 22, 24 can be moved via a drive apparatus 26 which comprises a lever 28.

If, for example, the lever 28 is moved counter-clockwise, the first footrest section 22 and the second footrest section 24 fold outward clockwise (cf. FIGS. 1*b* and 2*b*).

The second footrest section 24 is furthermore also pushed out in a straight line relative to the first footrest section 22 by the movement of the lever 28. The footrest surface is thereby greatly increased (cf. FIGS. 1*c* and 2*c*).

If the lever 28 is adjusted back, the second footrest section 24 moves back in and the footrest sections 22, 24 are again pivoted beneath the seat part 10.

Figure 3:
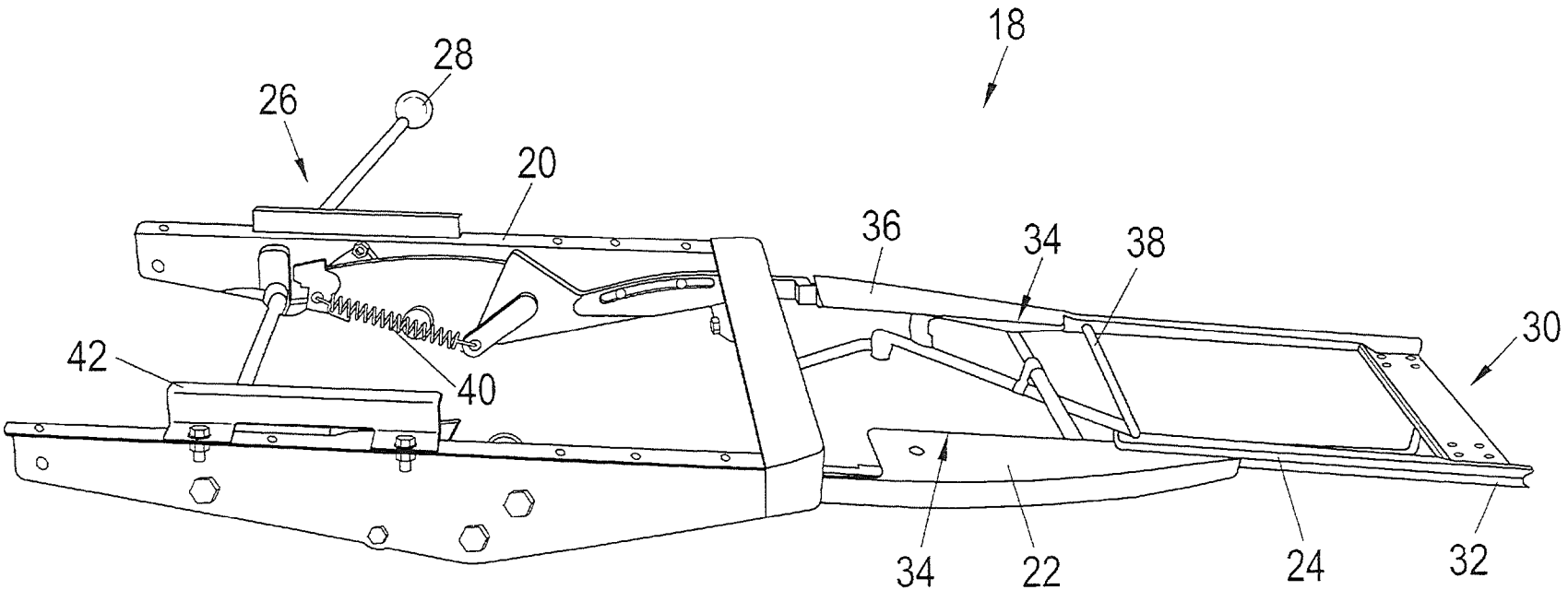

A footrest apparatus 18 is shown by way of example in FIG. 3. The first footrest section 22 is folded outward in this respect. The second footrest section 24 is also pushed out. A rail guide 30 is provided for this purpose. The first footrest section 22 has a longitudinal groove at both sides into which the inner edges 34 of the second footrest section 24 engage.

For the pivoting, the drive apparatus 26 comprises a first fitting 36 and a second fitting 38 for extending or retracting the second footrest section 34. The drive apparatus 26 can furthermore comprise a spiral spring 40 to support the adjustment movement.

Guide rails 42 are provided for fastening the substantially rectangular support frame 20 at the seat part 10. Alternatively, any other fastening possibilities can also be selected, for example perforated metal sheets.

Figure 4A:
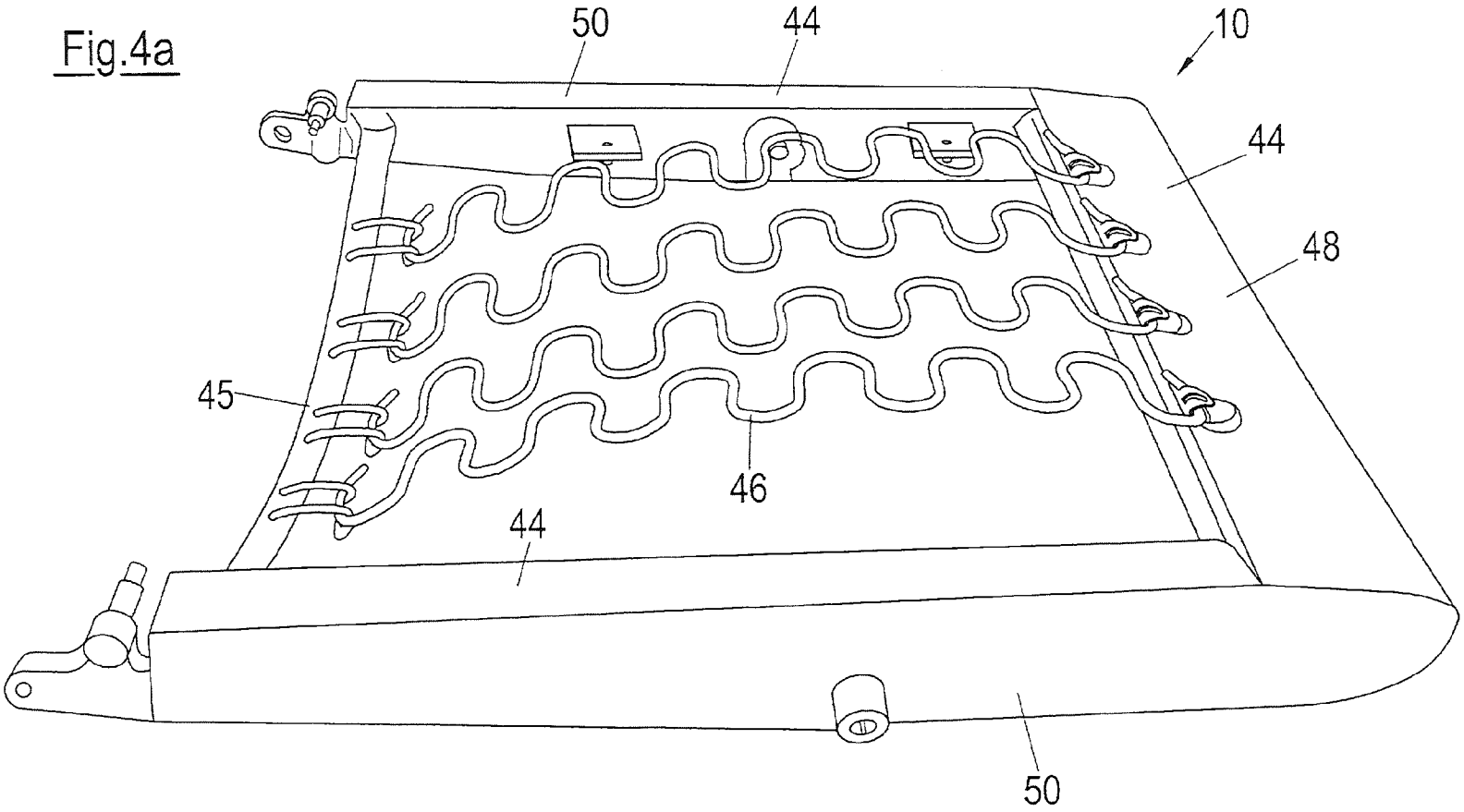

A plan view of a seat part 10 is shown in FIG. 4*a*. The rectangular basic shape is in this respect formed with the aid of border plates 44 and a tube 45.

To obtain sufficient space for the support frame 20 or a fastening for the support frame 20 beneath the seat part 10, springs 46 are tensioned longitudinally which are transversely tensioned in conventional armchairs having a cantilever support structure. The springs 46 thus extend substantially in parallel with side supports 50 and perpendicular to a front support 48.

The springs 46 can be welded at one side to the seat part 10 at the front support 48 and can be hung on at the other side.

Figure 4B:
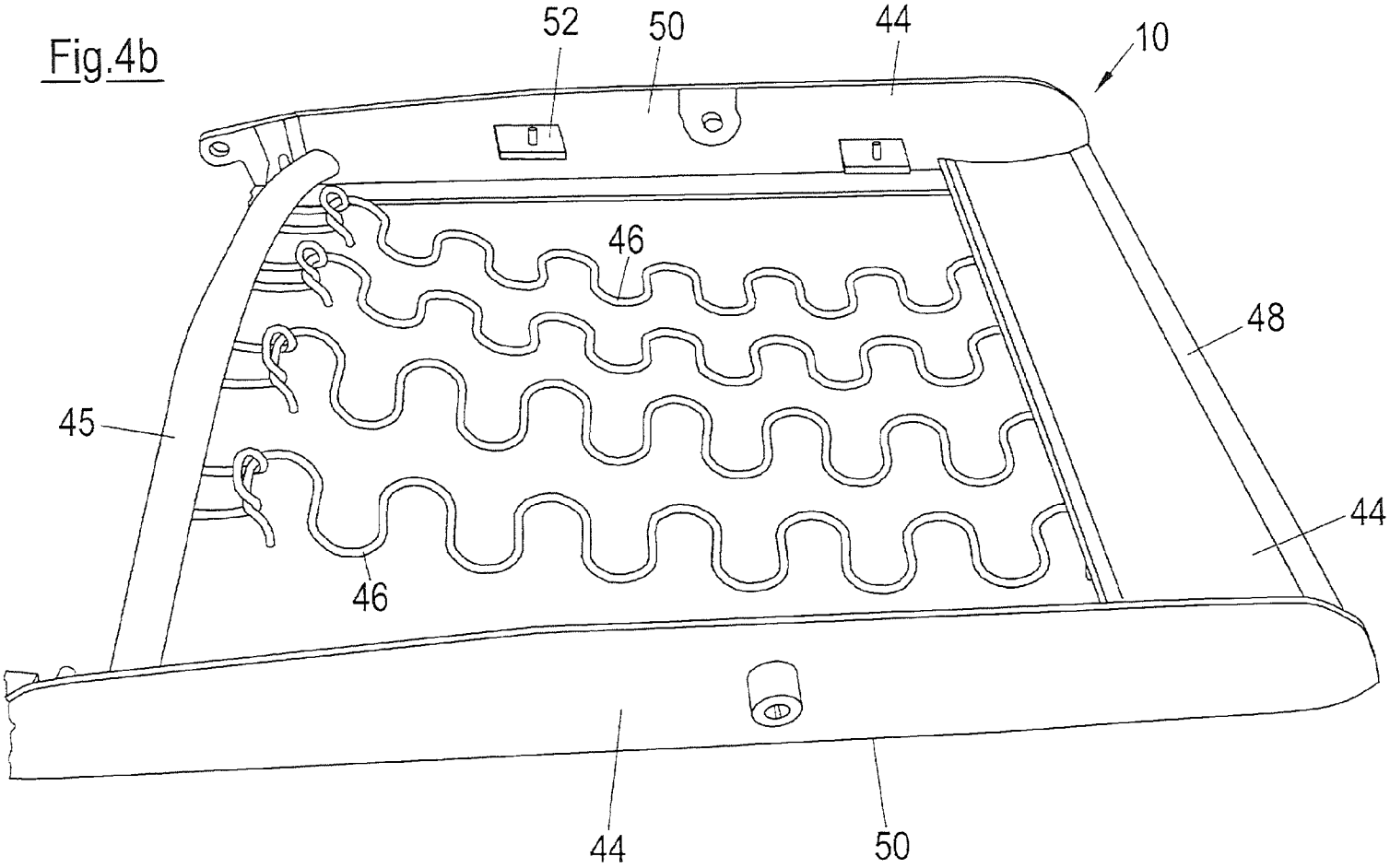
Figure 5A:
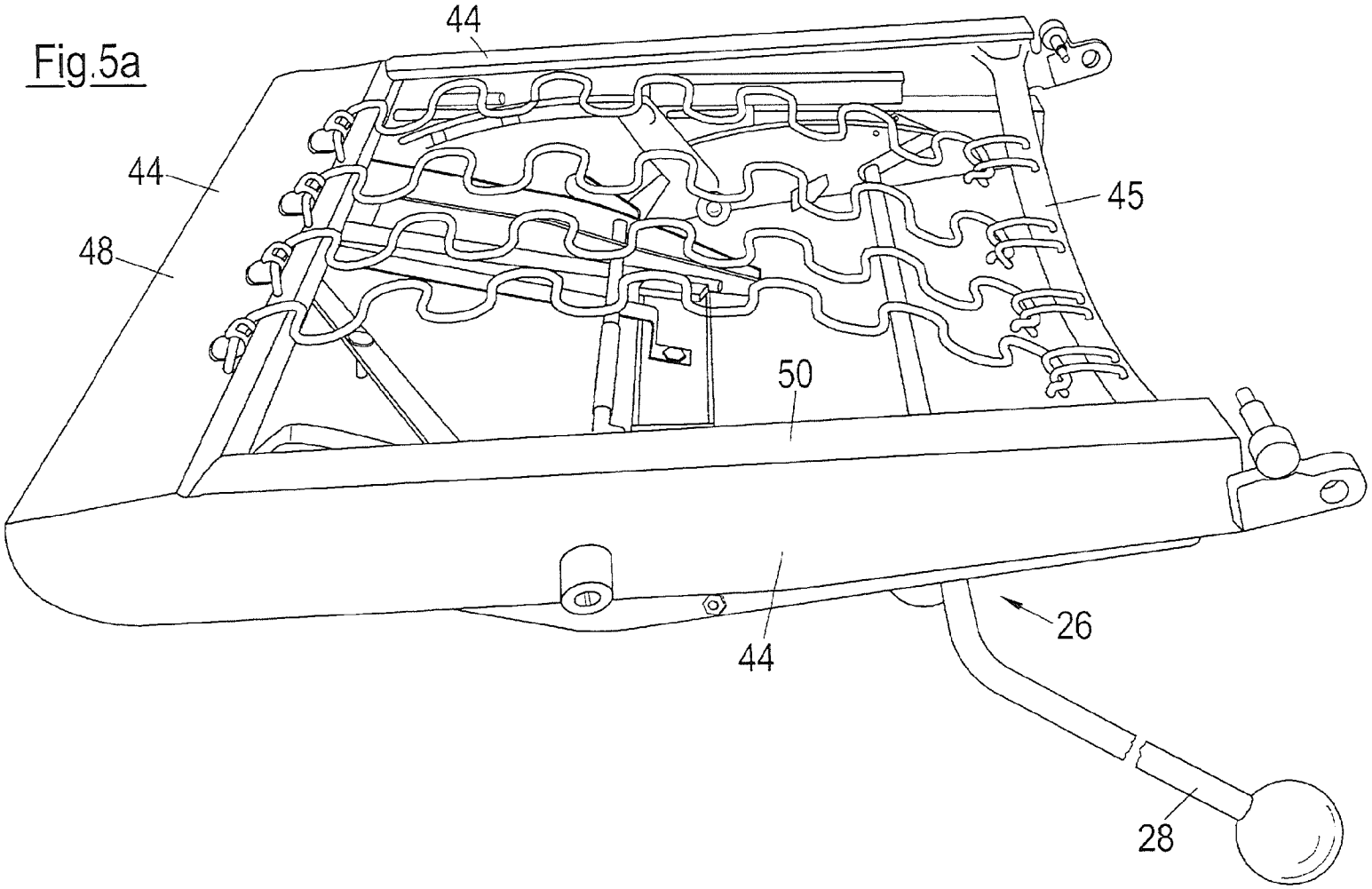
Figure 5B:
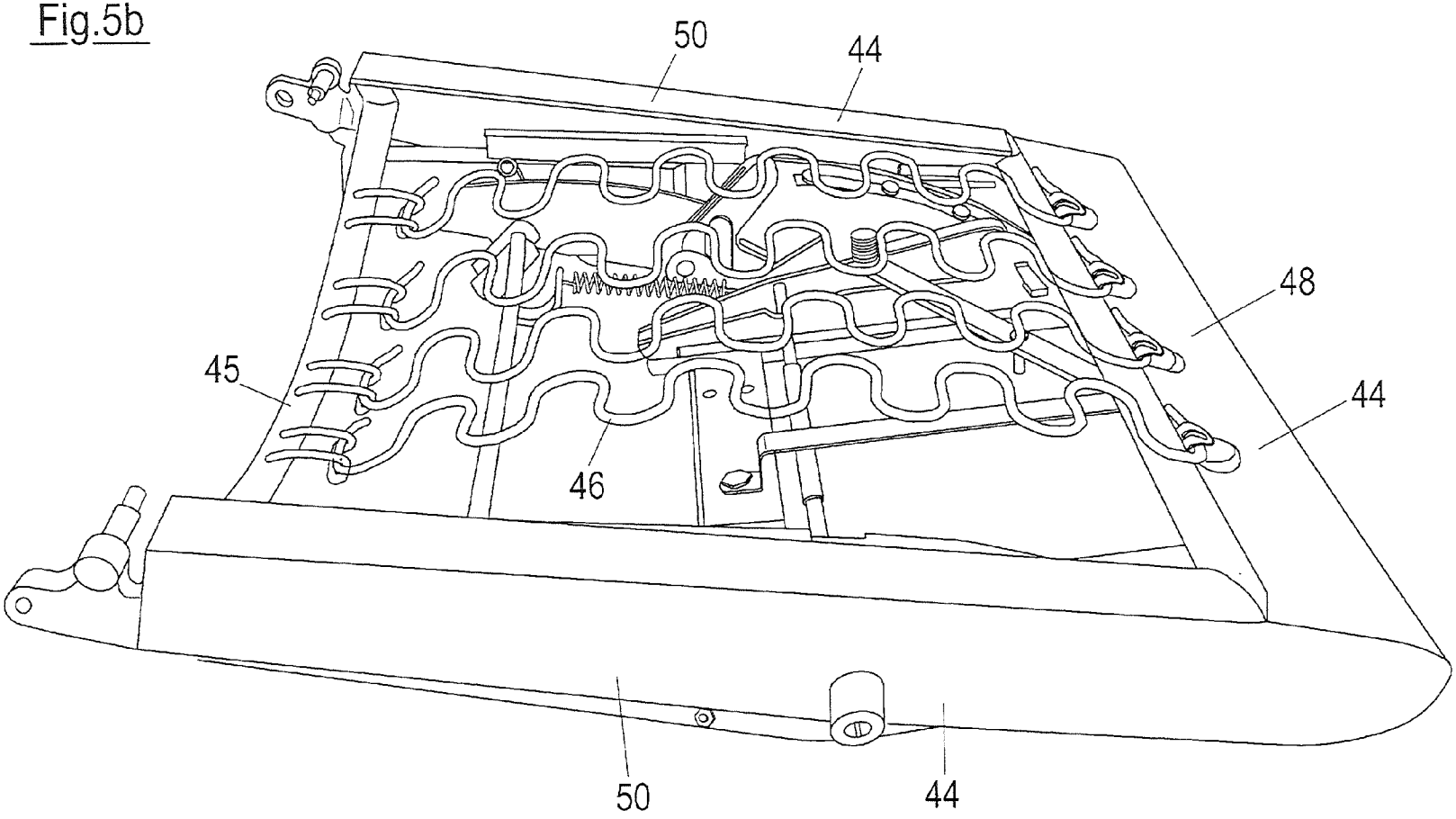
Figure 5C:
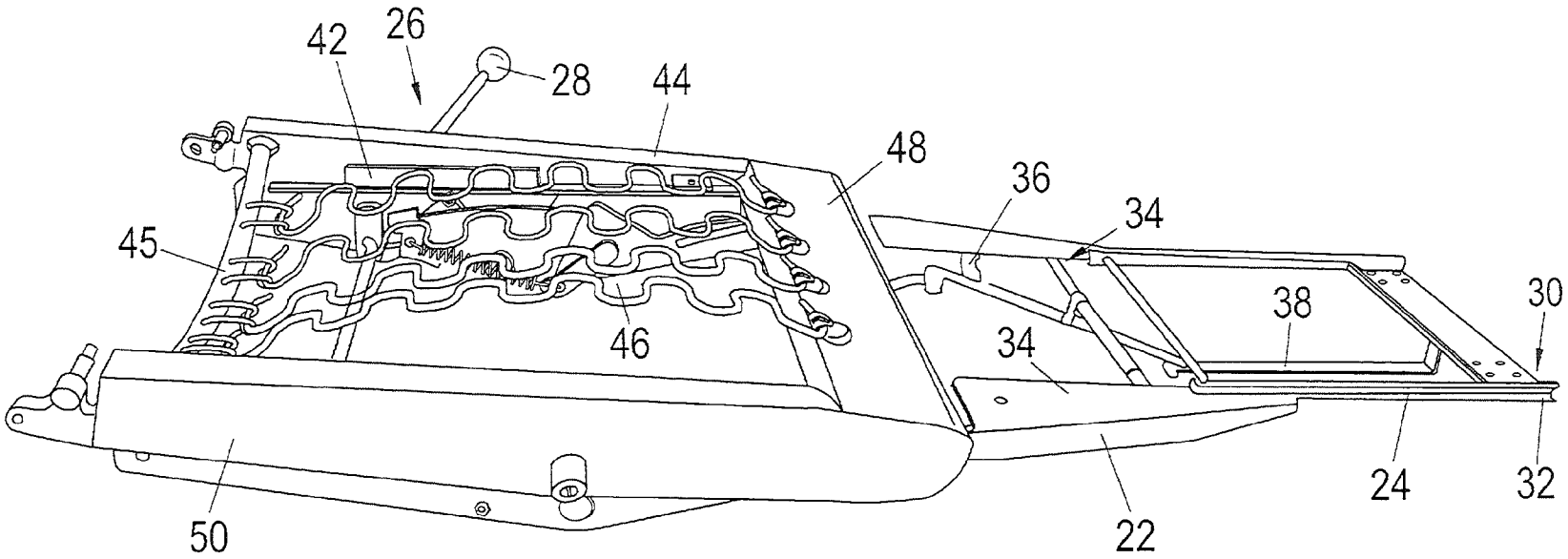
Figure 6A:
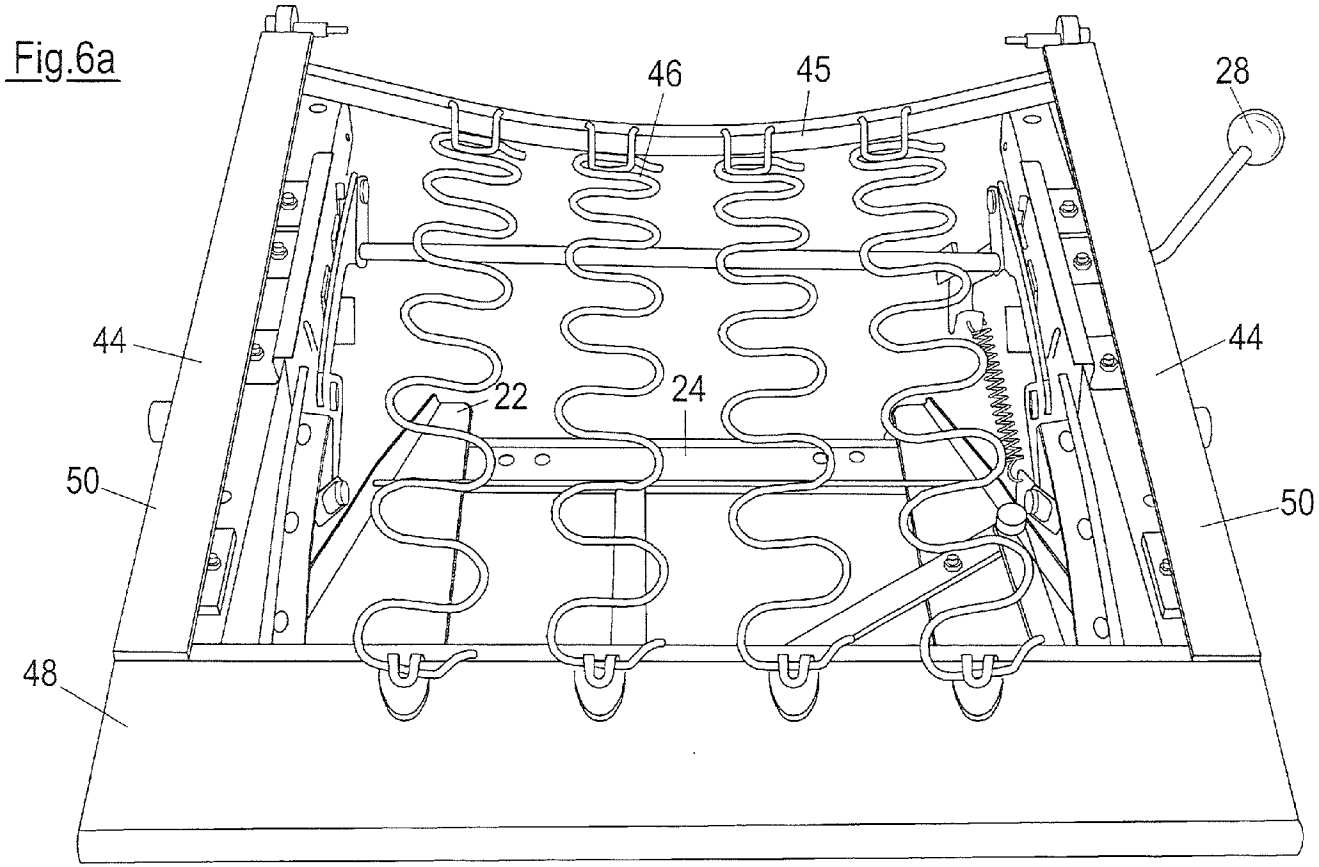
Figure 6B:
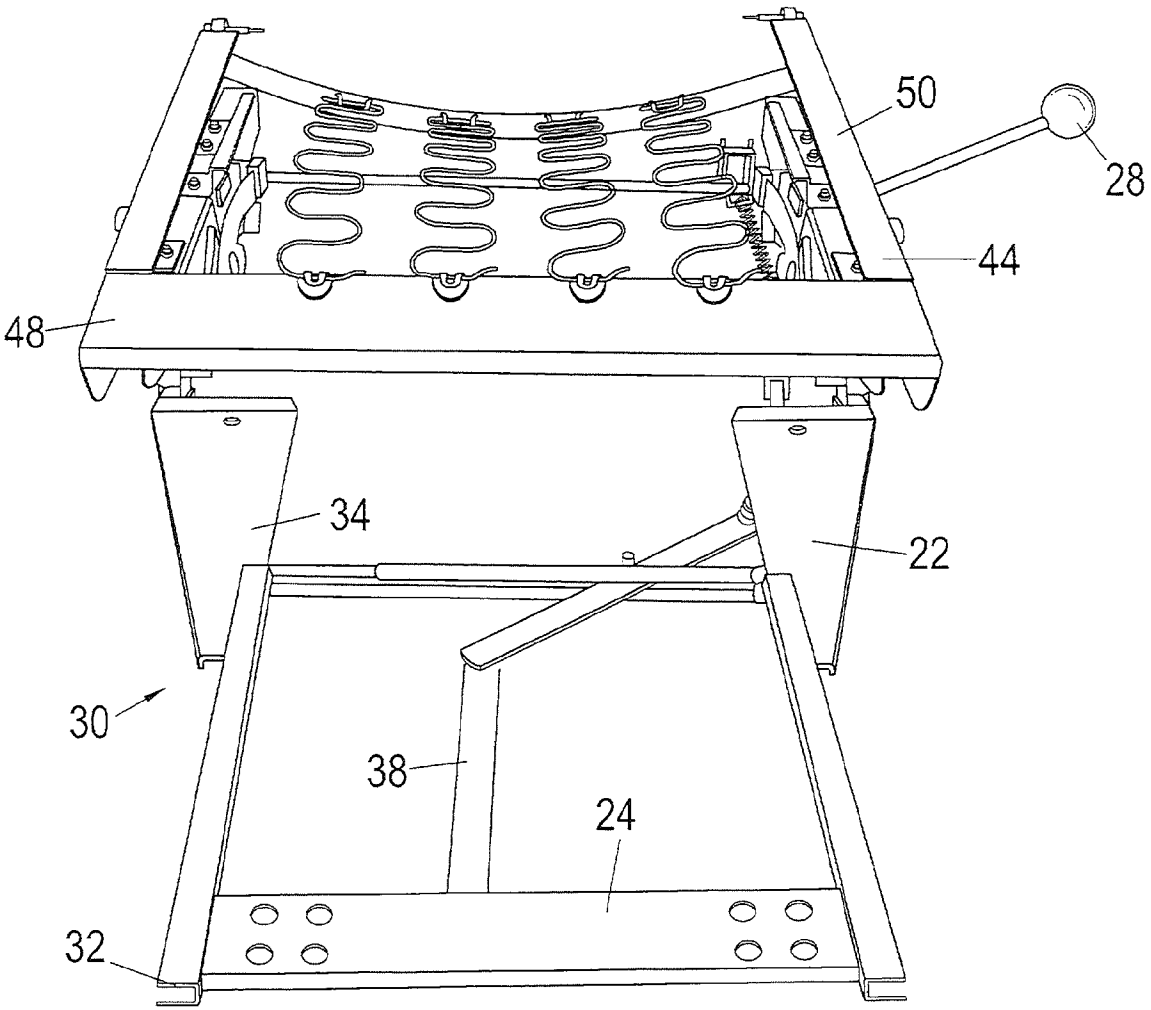

A bottom view of the seat part 10 is shown in FIG. 4*b*. The front support 48 has a smaller height in comparison with the side supports 50. The front support 48 is flat and folded. This support 48 is also upwardly displaced in comparison with the lower edge of the side support 50 in the installed state. In addition, the front support 48 is straight and not bent. These measures serve to provide sufficient space for a pivot movement of the footrest sections 22, 24.

The side supports 50 oriented perpendicular to the front support 48 are higher than the front support 48 since a holding apparatus is provided at them for receiving the guide rails 42 of the support frame 20.

The support frame 20 can consequently be pushed beneath the seat part 10 like a drawer or a cassette and can be fastened there, for example screwed and/or welded. The footrest apparatus thus forms a module.

Different views in which the support frame 20 and the seat part 10 are assembled are shown in FIGS. 5*a* to 6*b*.

The seat part 10 and the footrest apparatus 18 can be connected to a back part 12. The individual components can be padded and/or upholstered.

The apparatus in accordance with the invention also enables an autonomous adjustment of the footrest with seating/reclining furniture having a cantilever support structure independently of the relative movement between the back part and the seat part, with a high comfort simultaneously being reached for a user.

REFERENCE NUMERAL LIST

10 seat part
12 back part
14 cantilever support structure
16 headrest
18 footrest apparatus
20 support frame
22 first footrest section
24 second footrest section
26 drive apparatus
28 lever
30 rail guide
32 longitudinal groove
34 inner edge
36 first fitting
38 second fitting
40 spiral spring
42 guide rail
44 border plate
45 tube
46 spring
48 front support
50 side support
52 holding apparatus
54 support hoop
56 base section
58 horizontal section
60 joint section

The invention claimed is:

1. A seating/reclining furniture, comprising a seat part; a back part which is pivotably connected to the seat part about a pivot axis and which is adjustable in inclination with respect to the seat part; and a cantilever support structure which supports the seat part and the back part and which has at least one support hoop which comprises a base section, an at least approximately horizontally extending horizontal section as well as a joint section connecting the base section and the horizontal section to one another and enabling a pivoting of the horizontal section relative to the base section, wherein the back part is pivotably supported at the horizontal section about a horizontal axis and the seat part is movably guided between fore and aft directions along the joint section, further comprising a footrest apparatus which comprises a support frame as well as a first and a second footrest section, with the first footrest section being pivotably supported at the support frame and being adjustable between a support position in which the first footrest section is arranged beneath and adjacent to the support frame and a working position in which the first footrest section projects over the seat part; and with the second footrest section being adjustable in a straight line relative to the first footrest section between a retracted position in which the footrest sections are at least partly overlapping and an extended position in which the second footrest section projects over the first footrest section; and with the footrest apparatus comprising a drive apparatus which effects a pivoting of the first footrest section relative to the support frame by means of a first fitting, independently of a change of the relative position of the back part and of the seat part with respect to one another, as well as a relative movement of the second footrest section to the first footrest section by means of a second fitting.

2. The seating/reclining furniture in accordance with claim 1, wherein the seating/reclining furniture is an armchair or a chair.

3. The seating/reclining furniture in accordance with claim 1, wherein the support frame is rectangular.

4. The seating/reclining furniture in accordance with claim 1, wherein the first and second fittings are coupled to one another.

5. The seating/reclining furniture in accordance with claim 1, wherein the drive apparatus is manually operable.

6. The seating/reclining furniture in accordance with claim 5, wherein the drive apparatus is manually operable by means of a lever.

7. The seating/reclining furniture in accordance with claim 1, wherein the seat part has a rectangular base shape.

8. The seating/reclining furniture in accordance with claim 1, wherein the seat part comprises border plates.

9. The seating/reclining furniture in accordance with claim 8, wherein the border plates are padded by a foam material.

10. The seating/reclining furniture in accordance with claim 1, wherein the lower side of the seat part is configured for receiving the support frame.

11. The seating/reclining furniture in accordance with claim 1, wherein the seat part has at least one holding apparatus for the support frame.

12. The seating/reclining furniture in accordance with claim 11, wherein the at least one holding apparatus for the support frame is at least one of a latch connection, a screw connection, a weld connection and a slot guide.

13. The seating/reclining furniture in accordance with claim 12, wherein the holding apparatus is arranged at the inner side of a side support of the seat part.

14. The seating/reclining furniture in accordance with claim 1, wherein a front support of the seat part has a smaller height than side supports of the seat part.

15. The seating/reclining furniture in accordance with claim 1, wherein the front support of the seat part is spaced further from the floor than the side supports of the seat part.

16. The seating/reclining furniture in accordance with claim 1, wherein a front support of the seat part is configured in a straight line.

* * * * *